US005090670A

United States Patent [19]

Yang

[11] Patent Number: 5,090,670

[45] Date of Patent: Feb. 25, 1992

[54] FORCIBLE TYPE C-TYPE CLAMP WITH PRE-STRESS PACKING FACE

[76] Inventor: Tai-Her Yang, 5-1 Taipin St., Si-Hu Town, Dzan-Hwa, Taiwan

[21] Appl. No.: 581,392

[22] Filed: Sep. 11, 1990

Related U.S. Application Data

[63] Continuation of Ser. No. 344,065, Apr. 25, 1989, abandoned.

[30] Foreign Application Priority Data

Apr. 27, 1988 [GB] United Kingdom ..... 8809984

[51] Int. Cl.[5] ..... B25B 1/10

[52] U.S. Cl. ..... 269/249; 269/40; 269/45

[58] Field of Search ..... 269/40, 43, 45, 249, 269/252, 275

[56] References Cited

U.S. PATENT DOCUMENTS 3,854,712 12/1974 McGee ..... 269/43
4,083,624 4/1978 Timmer ..... 269/249
4,105,344 8/1978 Rousom ..... 269/249
4,607,829 8/1986 Suska ..... 269/249
4,747,590 5/1988 Yang ..... 269/249

*Primary Examiner*—J. J. Hartman
*Attorney, Agent, or Firm*—Leonard Bloom

[57] ABSTRACT

A C-clamp which may be clamped by a second C-clamp, so that large and irregular shaped workpieces may be clamped thereby, and further so that additional strength and stability is provided. The C-clamp includes an internal clamping face that contacts the workpiece during the clamping thereof. The C-clamp further includes a pair of external clamping faces that are contacted and clamped by the second C-clamp. The arm of the C-clamp that has the internal clamping face formed thereon has the external clamping faces substantially aligned therewith, so that vibrations produced by work being done on the workpiece are minimized. The clamp includes clamping heads that automatically pivot and swivel to accommodate the shape and angle of the surface and angle of the surface of the workpiece being clamped therewith.

3 Claims, 3 Drawing Sheets

FIG. 7
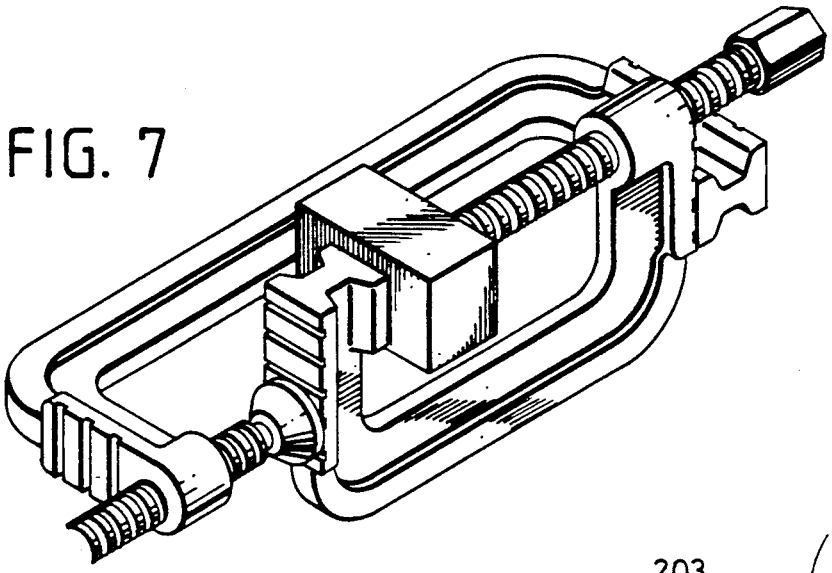
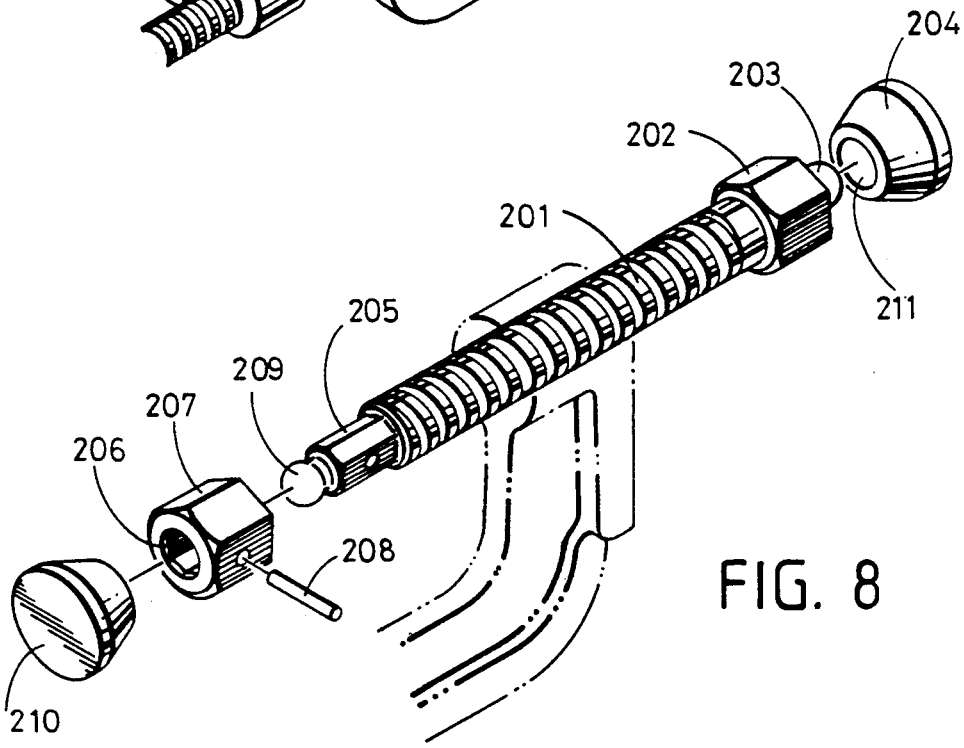
FIG. 8
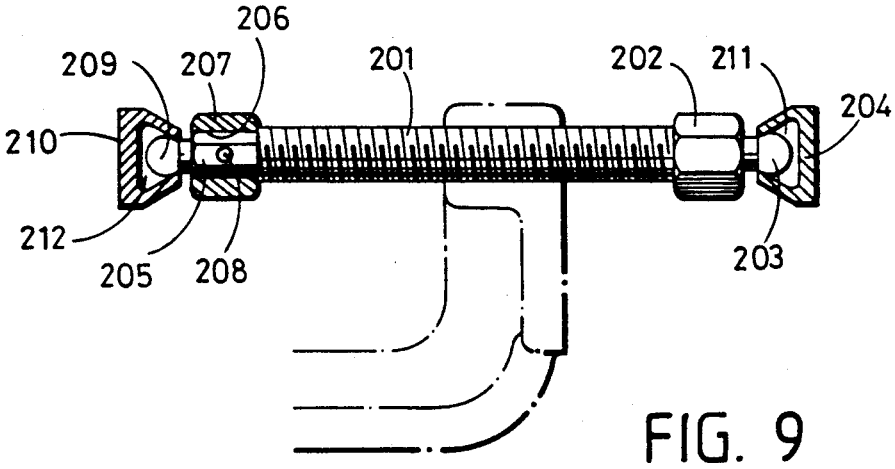
FIG. 9

FORCIBLE TYPE C-TYPE CLAMP WITH PRE-STRESS PACKING FACE

This application is a continuation of application Ser. No. 344,065, filed Apr. 25, 1989, now abandoned.

FIELD OF THE INVENTION

The present invention relates to C-clamps and, in particular, to C-clamps for clamping a workpiece, which C-clamps may be clamped by other traditional C-clamps for being secured and retained in a particular position, so that work performed on the workpiece.

BACKGROUND OF THE INVENTION

Traditional C-clamps (C-type clamps) include a C-shaped body that has a fixed clamping face disposed on an internal face of one of the two arms thereof. The other of the two arms of the C-clamp includes a tapped longitudinal hole in which an externally-threaded clamping rod is received. Disposed and carried in this manner, the clamping rod may move in a first and second opposite longitudinal direction for clamping and unclamping of a workpiece.

The clamping rods of traditional C-clamps ar equipped with a driving end, whereon pressure, etc., is applied for driving (i.e., by rotation of the clamping rod) the clamping rod in the first and second opposite directions. The other opposite end of such traditional clamping rods are often equipped with clamping heads (or faces) which, in combination with a clamping surface on the internal face of the one of the two-arms of the C-clamp, contacts or presses against the workpiece for clamping the workpiece therebetween.

Such traditional C-clamps have been widely used for clamping workpieces so that work, such as milling, welding or other types of processing, may be performed work thereon.

While being generally useful for their intended purposes, such traditional C-clamps have room for improvement. First, because such traditional clamps are secured directly to a stabilizing surface (such as a table), they are often difficult and/or impossible to use due when large or irregular sized and/or shaped workpieces are involved. Second, such clamps are often subject to vibrations, etc., which may result from work being performed on the workpiece being clamped thereby.

Thus, it can be seen that there remains a need for C-clamps for the clamping of workpieces which clamps may be simply and easily secured in place by the use of traditional C-clamps, so that large and/or irregular shaped workpieces may be satisfactorily clamped thereby. There further remains a need for such C-clamps which may be clamped by, for example, traditional C-clamps in such a manner that additional support and stability is provided, so that the vibrations, etc., resulting from work being performed on the workpiece being clamped thereby, is minimized and/or eliminated.

SUMMARY OF THE INVENTION

It is a primary object of the present invention to provide a C-clamp which may be secured and held in place by a traditional C-clamp for the clamping of a workpiece, and in particular a large and/or irregularly-shaped workpiece.

It is another primary object of the present invention to provide such a C-clamp which may be secured or clamped by a second C-clamp (for example, a traditional C-clamp) in such a manner that the second C-clamp lends the overall structure added strength, support and stability for minimizing and/or preventing vibrations, etc., resulting from work being done on the workpiece.

It is another object of the present invention to provide such a C-clamp for the clamping of irregularly-shaped workpiece, which C-clamp includes an improved clamping head for automatically adjusting itself to the orientation of the surface of the workpiece to be clamped thereby.

In accordance with the teachings of the present invention, there is disclosed a C-clamp having a frame including a first arm and a second opposite arm. The first and second arms are substantially parallel to one another. An internal clamping face is formed on the first arm, so as to face the second arm. A clamping rod is carried by the second arm for longitudinal movement in a first clamping direction and in a second, opposite unclamping direction. In the first clamping direction, the clamping rod moves towards the internal clamping face for clamping of a workpiece therebetween. In the second opposite unclamping direction, the clamping rod moves away from the internal clamping surface for unclamping of a workpiece located therebetween. An external clamping face is formed on each of the external surfaces of the first and second arms. The external clamping faces are substantially parallel to one another. This permits the C-clamp to be secured in place by a second C-clamp, whose own internal clamping faces overlay and clamp the external clamping faces of the C-clamp for securing the C-clamp in place by the second C-clamp. The external clamping faces are further substantially parallel to the respective internal clamping faces. In this fashion, the clamping by the second clamp on the external faces provides additional stability and strength for the clamping of workpieces, so that vibrations, etc., resulting from the work performed on the workpieces clamped thereby are reduced and minimized.

These and other objects of the present invention will become readily apparent from a reading of the following description when read in conjunction with the enclosed drawings.

BRIEF DESCRIPTION OF THE DRAWINGS

FIG. 7 is another perspective view of the clamp of the present invention illustrating another way that the C-clamp is clamped by a second C-clamp which, as illustrated therein, is also a C-clamp of the present invention, while the C-clamp of the present invention is clamping a workpiece for working thereon.

FIG. 8 is an exploded view of a preferred embodiment of a clamping rod for the C-clamp of the present invention.

FIG. 9 is a side view, in partial cross-section, of the clamping rod of FIG. 8.

DESCRIPTION OF THE INVENTION

Figure 1:
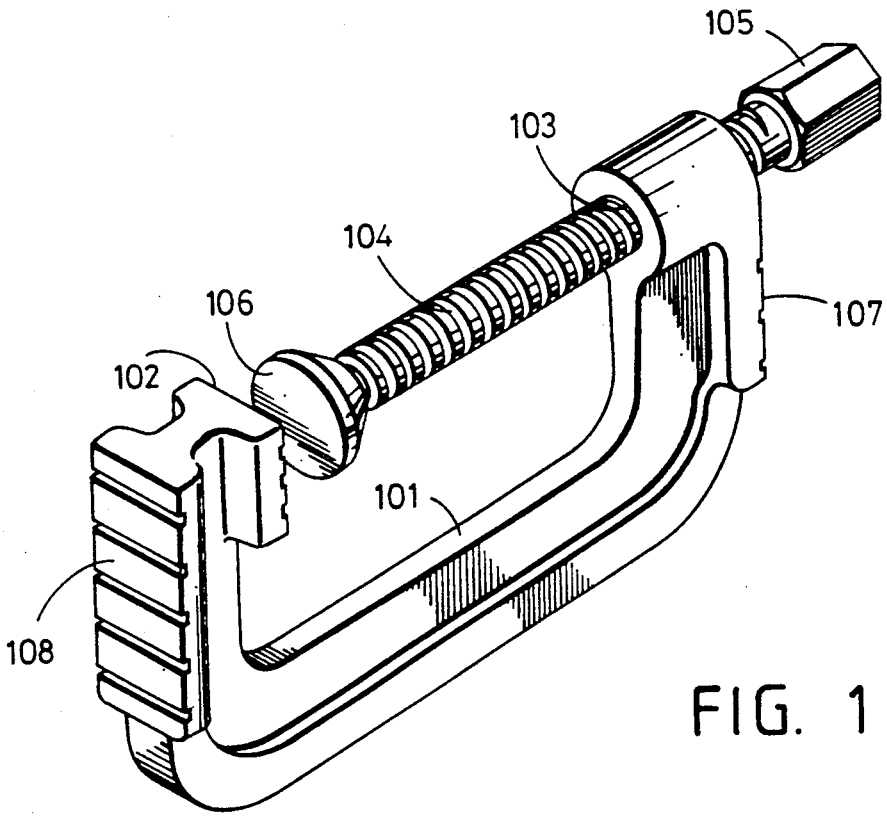
FIG. 1 is a perspective view of the C-clamp of the present invention.

With reference now to the drawings, the C-clamp of the present invention has a substantially C-shaped frame 101 including a first arm and a second opposite arm (same-way bending and extending ends). The arms may either be integral with one another or they may be joined by an intermediate shank portion. Preferably, these opposite arms are substantially parallel to one another.

The frame includes an internal surface (side) and an opposite external surface (side).

Formed on the first arm is an internal clamping face (fixed clamping claw) 102. The internal clamping face 102 is located on the internal surface substantially facing the second opposite arm.

A clamping rod (packing or driving screw rod) 104 is carried by the second arm for longitudinal movement in opposite first clamping and second unclamping directions. This is preferably achieved by the second opposite arm having a tapped bore (longitude tap hole) 103 formed therethrough which is substantially perpendicular to the internal clamping face 102. The rod 104 is externally (annularly) threaded for threadably mating with the bore 103, permitting rotational longitudinal movement of the rod 104 in the bore 103 in the first and second opposite directions.

The clamping rod 104 has respective first and a second opposite ends. The first end of the clamping rod 104 has a drive member (drive head) 105 formed thereon. The drive member 105 receives the force from, for example, a wrench or other hand tool, required to rotate the rod 104 in the bore 103, so that the rod 104 moves in either the first or the second opposite directions. The second end of the clamping rod 104 has a clamping head 106 carried thereon for longitudinal movement therewith. The clamping head 106 includes a clamping face that contacts workpieces during the clamping thereof.

Formed in the manner described above, the clamping rod 104 is rotated in the bore 103 for being moved in the first clamping direction for the clamping of a workpiece therebetween. The clamping rod 104 may, alternatively, be rotated in the bore 103 in an opposite direction for being moved in the second opposite direction for the unclamping of a workpiece that is located therebetween.

Figure 6:
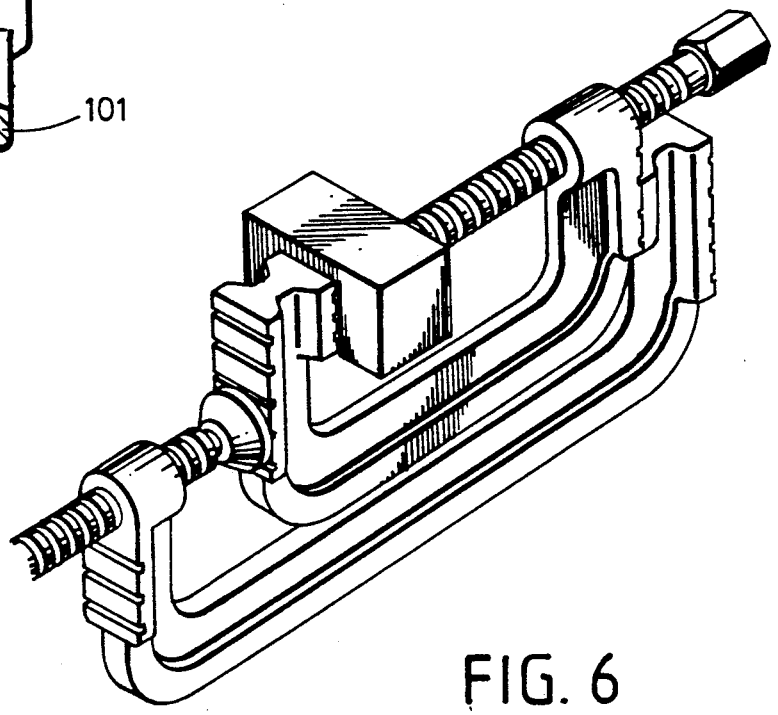
FIG. 6 is a perspective view of the clamp of the present invention illustrating how the C-clamp is clamped by a second C-clamp which, as illustrated therein, is also a C-clamp of the present invention.

Formed on each of the external surfaces of the first and second arms is a respective external clamping face (pre-stress packing faces) 107 and 108. These external clamping faces 107 and 108 are substantially parallel to one another. In this fashion, the C-clamp of the present invention may be clamped and secured in place by a second C-clamp, whose own internal clamping faces overlay and clamp the external clamping faces 107 and 108 (see FIGS. 6 and 7).

The external clamping faces 107 and 108 are further substantially parallel to the internal clamping face 102 with the external surface 108 on the first arm being substantially aligned with the internal clamping face 102. In this fashion, when the C-clamp of the present invention is being clamped by a second C-clamp, additional stability and strength is provided for the clamping of workpieces. This additional stability reduces and minimizes the vibrations, etc., that are produced by work being performed on workpieces being held by the C-clamp of the present invention.

Preferably, the external clamping faces 107 and 108 have teeth formed thereon for reducing slippage that can occur during clamping and working operations.

Figure 2:
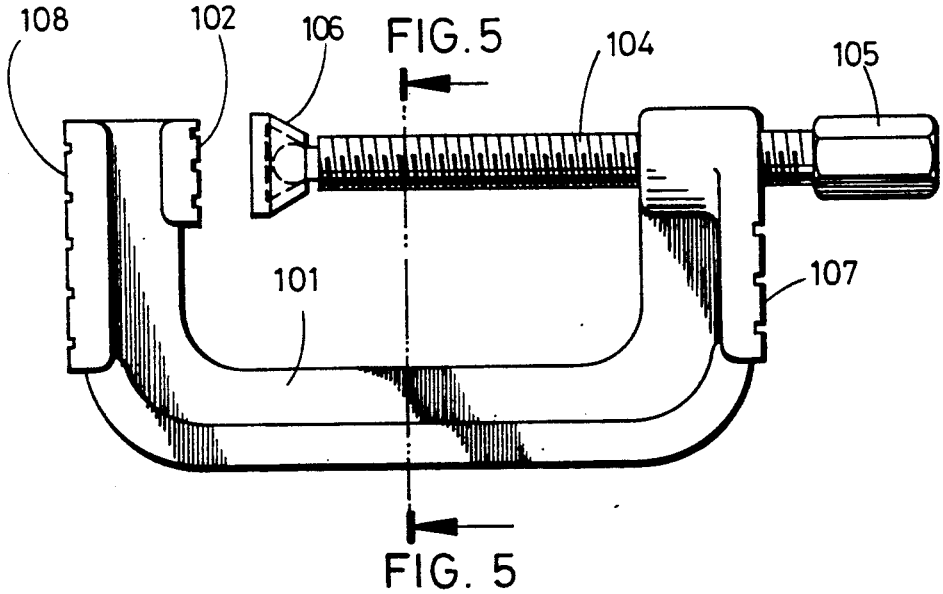
FIG. 2 is a side view of the C-clamp of FIG. 1.
Figure 3:
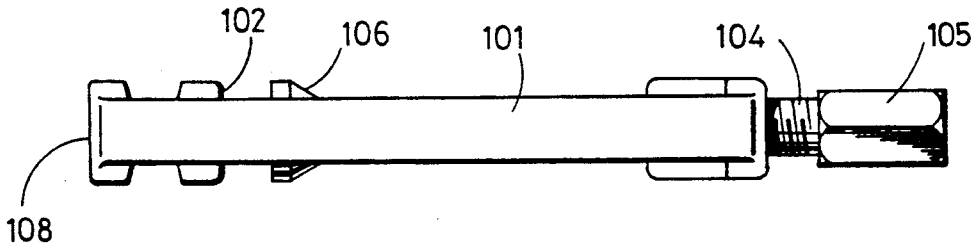
FIG. 3 is a bottom view of the C-clamp of FIG. 1.
Figure 4:
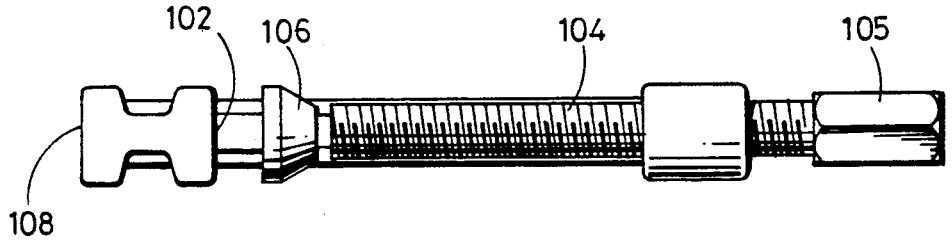
FIG. 4 is an overhead view of the C-clamp of FIG. 1.
Figure 5:
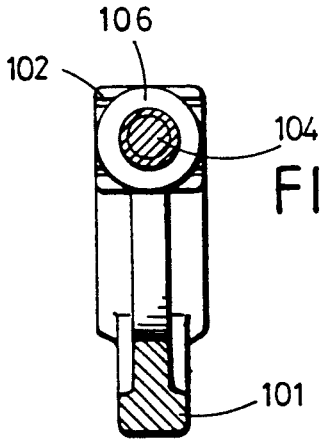
FIG. 5 is a cross-section view of the C-clamp of the present invention taken along lines 5—5 of FIG. 2.

It is further preferred that the clamping head 106 be carried on the second end of the rod 104, so that the head 106 may swivel in relation to the rod 104. With particular reference now to FIG. 2, the second end of the rod 104 has a rounded swivel head (convex ball-shaped bar) formed thereon, so as to longitudinally extend forwardly therefrom. The clamping head 106 is substantially frustum-shaped with a flat forward clamping surface and an annular skirt depending rearwardly therefrom. The annular skirt terminates in an aperture through which the swivel head passes for being received in the head 106. Placed in this manner, the head 106 may swivel and pivot on the swivel head in response to the shape of the surface of the workpiece being clamped thereby.

Referring in particular now to FIGS. 8 and 9, another embodiment for the clamping rod (bilateral packing screw) 201 is illustrated, wherein both ends of the rod 201 are provided with clamping heads for the clamping of workpieces. The rod 201 has opposite first and second ends. Once again, the first end has a drive member (hexhead) 202 formed thereon. This drive member 202, like member 105 discussed above, receives the force for rotating the rod 201. Extending longitudinally rearwardly from the member 202 is a first rounded swivel head (convex ball-shape bar) 203. This swivel head 203 is received in a first clamping head 211 that includes a respective clamping surface 204 and annular skirt, in the same manner as described above relative to FIG. 2.

The second end of the rod 201 has a polygonal-shaped section 205 formed thereon extending longitudinally forwardly therefrom. A bore is formed in the section 205 extending along an axis that is perpendicular to the longitudinal axis of the rod 201. Received over the section 205 is a polygonal driving nut (hexagon nut) 207. The nut 207 has a hole 206 formed therethrough that is shaped so as to mate with the section 205. In this fashion, rotation of the nut 207 will concomitantly rotate the section 205 (and hence the rod 201) therewith. The nut 207 is provided for receiving force applied thereto for rotation of the rod 201 to effectuate the clamping and unclamping of workpieces.

Nut 207 also has a bore formed therethrough. The hole 208 is located on an axis that is substantially perpendicular to the longitudinal axis of the rod 201. In the above fashion, the nut 207 may be received on the section 205 with the bores thereof being substantially aligned with one another. A securing pin (lateral pin) 208 is then received through the aligned holes in the nut 207 and in the section 205, so that longitudinal movement of the nut 207 on (relative to) the section 205 is prevented.

Finally, the second end of the rod 201 also has a second rounded swivel head (convex ball-shape bar) 209 formed thereon forwardly of the section 205. Swivel head 209 extends substantially longitudinally forwardly from the section 205. This swivel head 209 is received in a second clamping head 212 that includes a respective clamping surface 210 and annular skirt, in the same manner as described above relative to FIG. 2.

Obviously many modifications may be made without departing from the basic spirit of the present invention. Accordingly, it will be appreciated by those skilled in the art that within the scope of the appended claims, the invention may be practiced other than has been specifically described herein.

I claim:

1. A combination of two C-clamps, a smaller C-clamp and a larger C-clamp, the combination comprising a larger C-shaped frame and a smaller C-shaped frame each including a first arm and a second opposite arm, the first and second arms of each respective clamp being substantially parallel to the opposite arm of the respective clamp;

an internal clamping face formed on the first arm of each clamp, so as to face the second opposite arm of the respective clamp;

a clamping rod carried by the second arm of each clamp for longitudinal movement in a first clamping direction toward the internal clamping face of the respective clamp for clamping a workpiece therebetween and in a second opposite direction away from the internal clamping face of the respective clamp for unclamping of a respective workpiece therebetween; and an external clamping face on each of the first and second arms of each clamp, the external clamping faces of each clamp extending outwardly beyond the respective parallel arms of the respective clamp, the external clamping face on the respective first arm being substantially parallel to the external clamping face on the respective second arm of each clamp, the clamping faces of each clamp having serrations formed thereon, the external faces of each clamp further being substantially parallel to the internal clamping face of the respective clamp, the smaller clamp being disposed with respect to the larger clamp such that one internal face of the larger clamp may engage one external face of the smaller clamp and the clamping rod of the larger clamp may engage the other external face of the small clamp such that the smaller C-clamp may be clamped and secured in a nested position with respect to the larger clamp.

2. The C-clamp of claim 1, further comprised of:

the clamping rod of each clamp including a respective clamping head for contacting the respective workpiece during clamping thereof, the clamping head of each clamp being received on a respective rounded swivel head formed on the clamping rod of each clamp, such that the clamping head of each clamp automatically swivels and adjusts for contacting the surface of the respective workpiece for the clamping thereof.

3. The C-clamp of claim 2, further comprised of:

the clamping rod of each clamp having a respective pair of opposite ends, each opposite end including a respective clamping head for contacting respective workpieces during the clamping thereof, the clamping heads of each clamp being received on respective rounded swivel heads formed on the respective opposite ends of each clamp, such that the clamping heads of each clamp automatically, independently swivel and adjust for contacting the surface of the respective workpiece for the clamping thereof.

* * * * *